United States Patent [19]

Nagashima

[11] Patent Number: 4,788,951

[45] Date of Patent: Dec. 6, 1988

[54] MEANS FOR MOUNTING CARBURETOR ON WORKING MACHINE WITH INTERNAL COMBUSTION ENGINE

[75] Inventor: Akira Nagashima, Kawasaki, Japan

[73] Assignee: Kioritz Corporation, Tokyo, Japan

[21] Appl. No.: 93,095

[22] Filed: Aug. 31, 1987

[30] Foreign Application Priority Data

Sep. 11, 1906 [JP] Japan ..... 61-139616[U]

[51] Int. Cl.[4] ..... F02B 77/00

[52] U.S. Cl. ..... 123/198 E; 123/195 C

[58] Field of Search ..... 123/195 C, 198 E, 195 A

[56] References Cited

U.S. PATENT DOCUMENTS

| | | | |
|---|---|---|---|
| 3,810,526 | 5/1974 | Kawasaki | 123/198 E |
| 4,224,919 | 9/1980 | Appelbaum | 123/198 E |
| 4,548,169 | 10/1985 | Nagashima | 123/198 E |
| 4,619,343 | 10/1986 | Lengerfelder | 123/198 E |

FOREIGN PATENT DOCUMENTS

| | | | |
|---|---|---|---|
| 110551 | 9/1981 | Japan | 123/198 E |
| 25059 | 2/1984 | Japan | 123/198 E |

*Primary Examiner*—E. Rollins Cross

*Attorney, Agent, or Firm*—Browdy and Neimark

[57] ABSTRACT

Mounting means for mounting a carburetor on a working machine with an internal combustion engine wherein a joint member which is made of a flexible and heat insulating material is formed with connecting portions, a flange portion provided on an air-fuel mixture discharging port of the carburetor is fit on and held by a recess on one of the connecting portions, while a flange portion at an intake port of the internal combustion engine is fit on and held by a recess on the other connecting portion, and the outer periphery of the joint member and the carburetor are sustained with fixed wall portions of the casing.

1 Claim, 1 Drawing Sheet

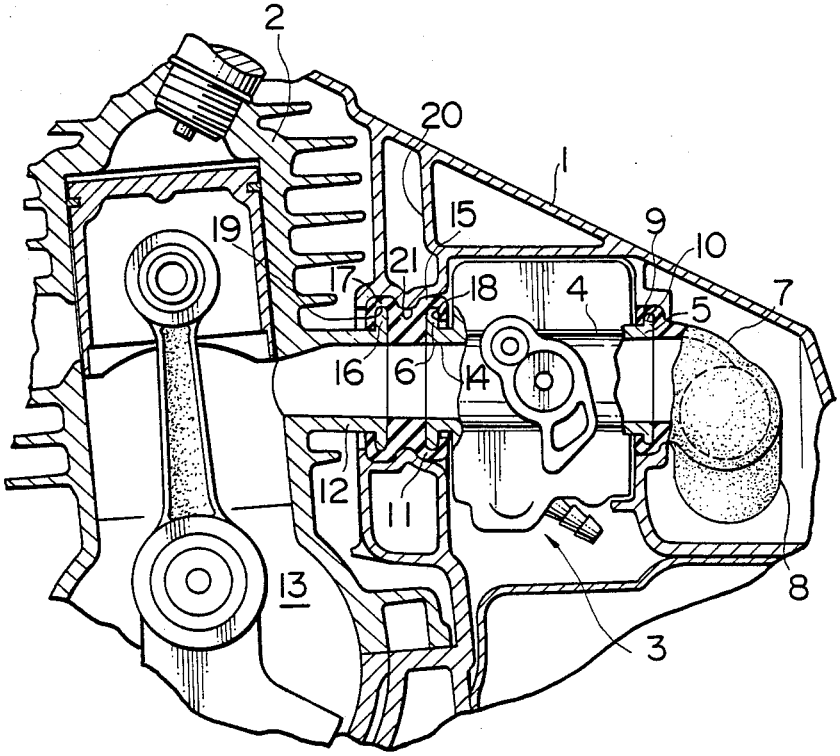
2
20
1
15
9
10
19
21
17
18
4
7
5
16
6
14
12
11
13
8
3

MEANS FOR MOUNTING CARBURETOR ON WORKING MACHINE WITH INTERNAL COMBUSTION ENGINE

BACKGROUND OF THE INVENTION

1. Field of the Invention:

The present invention relates to mounting means for a carburetor and, more particularly, to a mounting arrangement for a carburetor supplying an air-fuel mixture into an internal combustion engine, in working machines having the internal combustion engine such as a chain saw.

2. Description of the Prior Art:

Conventionally, a carburetor used in the working machine of this type has been disposed adjacent to a cylinder of an internal combustion engine, and such a carburetor is usually mounted on the cylinder by way of bolts or the like. Thus the carburetor is decreased in isolation capacity against heat and vibration, and ensuring the carburetor for desired attachment by the bolts may restrict configuration for the carburetor as well as a design of casing structure. Further a thicker structure for attachment portions is necessary in order to obtain the sufficient clamping strength from the bolts, and these cause problems inhibiting a requirement that the machine is to be decreased in size and reduced in weight.

SUMMARY OF THE INVENTION

Accordingly, it is an object of the present invention to resolve the problems in a mounting structure for the carburetor of this conventional type, and to provide a carburetor mounting system having a simple structure.

That is, in order to resolve the foregoing problems, mounting means for a carburetor according to the present invention includes a joint member, which is made of a flexible and heat insulating material and defines a passage therethrough, is formed integrally with connecting portions defining recesses on inner peripheral walls at the respective opposite ends of the joint member, a flange portion provided on an air-fuel mixture discharging port of the carburetor is fit on and held by the recess on one of the connecting portions, while a flange portion at an intake port of the internal combustion engine is fit on and held by the recess on the other connecting portion, and the outer periphery of the joint member and the carburetor are sustained with fixed wall portions of the casing.

In such an arrangement according to the present invention, the joint member will connect the flange portion in an airtight manner at the air-fuel mixture discharging port of the carburetor provided on the side of internal combustion engine with the flange portion on the intake port of the internal combustion engine to supply the air-fuel mixture from the carburetor to the internal combustion engine and to hold the joint member and the carburetor through the fixed wall portion of the casing.

In other words, since the carburetor is fittedly connected on the internal combustion engine through the joint member, which is made of a material having high insulation capacity to heat and vibration and also held by the fixed wall portion, the heat and vibration transmission to the carburetor can be conspicuously reduced so that the performance of the carburetor is highly maintained. Because the mounting bolts for the carburetor become needless, the restrictions against the carburetor design is further reduced and the design for carburetor passages is relatively freely made.

The present invention can provide, accordingly, an improved simple mounting arrangement which enables a carburetor to be reduced in size and weight and readily incorporated into a casing.

BRIEF DESCRIPTION OF THE DRAWING

The drawing is a vertical cross-sectional view showing a main part of a chain saw in accordance with one embodiment of the present invention.

DESCRIPTION OF THE PREFERRED EMBODIMENT

The present invention will be fully described hereinafter with reference to the drawing showing one preferred embodiment.

The illustrated embodiment is an example in which the invention is applied to an chain saw, within a casing 1 of this chain saw an internal combustion engine 2 is incorporated as a power source. It is preferable that the casing 1 is of, for example, synthetic resins to form a unit shell whose one end is opened. Adjacent to the internal combustion engine 2, mounted within the casing 1 is a carburetor 3 inserted through one side of the casing 1. This carburetor 3 includes a tubular passage 4 whose opposite ends open and, a throttle value and a butterfly value (not shown) serving as a choke value are provided in the tubular passage 4. At the both ends of the tubular passage 4, flanges 5 and 6 are formed integral with an air suction port and an air-fuel mixture discharging port and extend radially outwardly therefrom.

The flange portion 5 at the air suction port of the tubular passage 4 is connected to an outlet pipe 8 of an air cleaner through a connecting bent duct 7 so that filtered air from the outlet pipe 8 of the air cleaner is introduced through the connecting duct 7 into the tubular passage 4 of the carburetor 3. The connecting duct 7 is made from flexible and heat insulating materials such as rubber or synthetic resins and the like and integrally formed with a connecting portion 9 which is adapted to airtightly fit on the flange portion 5 at the air suction port of the tubular passage 4. The connecting portion 9 comprises an annular recess 10 provided on an inner wall of the connecting pipe 7. The flange portion 5 of the tubular passage 4 is airtightly fit on and held by the annular recess 10.

The flange portion 6 at the air-fuel mixture discharging port of the tubular passage 4 of the carburetor 3 is communicated to an intake port 12 of the internal combustion engine 2 through a joint member 11 in order to supply the air-fuel mixture to a crank case 13 of the internal combustion engine 2.

The joint member 11 is made of flexible and heat insulating materials such as rubber or synthetic resins and the like, within which a passage 14 is provided extending coaxially to passages in the tubular passage 4 of the carburetor 3 and the intake port 12 of the internal combustion engine 2. Further, the joint member 11 is integrally formed at one end with an annular connecting portion 15, which is adapted to airtightly fit on the flange portion 6 at the air-fuel mixture discharging port of the tubular passage 4 and, at the other end of the joint member 11 there is also integrally formed with a second annular connecting portion 17 which is adapted to airtightly fit on a flange portion 16 formed on the distal end of the intake port 12 of the internal combustion engine 2.

The connecting portions 15 and 17 define annular recesses 18 and 19 on respective inner walls at the both ends of the joint number 11. The flange portion 6 at the air-fuel mixture discharging port of the tubular passage 4 is airtightly fit on and held within one of the annular recesses 18 and, the flange portion 16 at the intake port 12 of the internal combustion engine 2 is airtightly fitted on and held within the other annular recess 19. According to the above arrangement, the internal combustion engine 2, the joint member 11, the carburetor 3 and the connecting duct 7 can be previously readily assembled with one another and, then, the assembled parts will be inserted into the casing 1 from its opened side and completed as one unit. Furthermore, the joint member 11 is so fitted, at its outer periphery, on a portion 21 of the fixing wall portion 20 of the casing 1 as to be securely held thereby. The carburetor 3 is also positioned and securely sustained in the same manner.

What is claimed is:

1. Mounting means for mounting a carburetor in a casing of a working machine with an internal combustion engine comprising:

a joint member, which is made of a flexible and heat insulating material and defines a passage therethrough;

connecting portions formed integrally with said joint member and defining recesses on inner peripheral walls at the respective opposite ends of the joint member;

a flange portion provided on an air-fuel mixture discharging port of the carburetor which is fit on and held by the recess on one of the connecting portions;

a flange portion at an intake port of the internal combustion engine which is fit on and held by the recess on the other connecting portion; and wherein the outer periphery of the joint member and the carburetor are sustained with fixed wall portions of the casing.

* * * * *